US008716657B2

(12) United States Patent
Mulligan

(10) Patent No.: US 8,716,657 B2
(45) Date of Patent: May 6, 2014

(54) HIGH SENSITIVITY MASS SPECTROMETRY SYSTEMS

(71) Applicant: Illinois State University, Normal, IL (US)

(72) Inventor: Christopher C. Mulligan, Normal, IL (US)

(73) Assignee: Illinois State University, Normal, IL (US)

( * ) Notice: Subject to any disclaimer, the term of this patent is extended or adjusted under 35 U.S.C. 154(b) by 0 days.

(21) Appl. No.: 14/055,440

(22) Filed: Oct. 16, 2013

(65) Prior Publication Data

US 2014/0042313 A1 Feb. 13, 2014

Related U.S. Application Data

(63) Continuation of application No. 13/470,057, filed on May 11, 2012, now Pat. No. 8,592,754.

(60) Provisional application No. 61/485,445, filed on May 12, 2011.

(51) Int. Cl.
*H01J 49/26* (2006.01)

(52) U.S. Cl.
USPC ..... 250/288; 250/281; 250/282

(58) Field of Classification Search
USPC ..... 250/281, 282, 288
See application file for complete search history.

(56) References Cited

U.S. PATENT DOCUMENTS

| | | | | |
|---|---|---|---|---|
| 7,462,824 | B2 | 12/2008 | Wang | |
| 8,592,754 | B2 * | 11/2013 | Mulligan | 250/282 |
| 2005/0199823 | A1 | 9/2005 | Franzen | |
| 2005/0230634 | A1 | 10/2005 | Bajic et al. | |
| 2006/0110833 | A1 | 5/2006 | Agnes et al. | |
| 2006/0273254 | A1 * | 12/2006 | Berkout et al. | 250/288 |
| 2007/0065946 | A1 * | 3/2007 | Reboud et al. | 436/63 |
| 2007/0187589 | A1 * | 8/2007 | Cooks et al. | 250/288 |
| 2010/0044560 | A1 | 2/2010 | Basile et al. | |

OTHER PUBLICATIONS

Search Report and Written Opinion established for PCT/US2012/037617 (Nov. 28, 2012).

* cited by examiner

*Primary Examiner* — Nicole Ippolito
(74) *Attorney, Agent, or Firm* — Drinker Biddle & Reath LLP

(57) ABSTRACT

A high sensitivity desorption electrospray ionization mass spectrometry system that employs a heated platform, along with means for directing a liquid stream containing an analyte of interest onto a target location on the heated platform to heat the stream, an electrospray emitter for generating an electrospray and directing the electrospray at the target location on the heated platform to produce an ionized, desorbed analyte, and a mass spectrometer for receiving and detecting the ionized, desorbed analyte.

27 Claims, 4 Drawing Sheets

HIGH SENSITIVITY MASS SPECTROMETRY SYSTEMS

CROSS-REFERENCE TO RELATED PATENT APPLICATIONS

This patent application is a continuation of copending U.S. patent application Ser. No. 13/470,057, filed May 11, 2012, which claims the benefit of U.S. Provisional Patent Application No. 61/485,445, filed May 12, 2011.

FIELD

Embodiments of the invention relate generally to high sensitivity mass spectrometry systems for identifying and quantifying analyte levels and, more particularly, to thermally-assisted desorption electrospray ionization mass spectrometry systems and ambient mass spectrometry systems in general for identifying and quantifying analyte levels.

BACKGROUND

Water quality measurement and its continuous monitoring is an important facet of many fields of science, including environmental protection and stewardship, biology and industrial hygiene. Society continues to benefit from innovations in chemical synthesis, but each newly developed chemical species has the potential to introduce water contamination. A prime example of this trend is that of the widespread use of otherwise highly desirable pharmaceuticals and personal care product (collectively, PPCPs) chemicals which are now also recognized as widespread water contaminants.

The accumulation of PPCPs as contaminants in environmental systems has become a major concern as usage of such chemicals continues to increase. Characterization of these chemicals in environmental samples represents a daunting task due to the breadth of different chemicals this encompasses, the diversity of sample matrices that are of interest (e.g. water, sludge, soil) and the multitude of routes of entry into the environment. For example, unused medications are often discarded improperly. Additionally, pharmaceuticals frequently undergo an incomplete metabolism in the human body, leaving the remainder to be naturally excreted and enter municipal wastewater systems. Also, the average person uses several consumer products related to hygiene daily, and these chemicals are rinsed away during bathing and enter wastewater systems in this way.

Conventional water treatment systems are efficient at removing most contaminants, but they are not designed or capable of removing all PPCPs, so these compounds and their degradation products regularly enter potable water supplies. While troubling targeted assessments have been reported, little is known regarding the ultimate environmental fate and potential risks of this class of chemicals. The ever-changing and persistent nature of this problem demonstrates that there is a real and immediate need for rapid, accurate monitoring of PPCP dispersion into water supplies and surrounding ecosystems so that proper remediation can be undertaken.

Aqueous environmental sample analysis is commonly done with mass spectrometry (MS) coupled with gas or liquid chromatographic separation, commonly employing high resolution or tandem MS analysis respectively referred to as GC-MS and LC-MC. Such hyphenated MS techniques are well regarded for their performance, particularly for their high quantitative analysis ability. But, while GC-MS and LC-MC offer many benefits, these techniques often require multiple instrumental methods to cover a broad range of analytes, suffer from long analysis times, and call for extensive sample preparation, making them not only time-consuming but also expensive.

Therefore, if a method of aqueous environmental sample analysis with high quantitative analysis ability that also covers a broad range of analytes, requires only short analysis times, and does not call for extensive sample preparation, an important advance in the art would be at hand. The present invention in its various embodiments provides such an advance.

SUMMARY

Embodiments of the present invention employ a unique, modified desorption electrospray ionization mass spectrometry (DESI-MS) system in the analysis of water-borne analytes comprising a wide array of PPCPs and other water contaminants. The analysis is carried out by directing charged microdroplets generated by a conventional pneumatically-assisted electrospray of an appropriate solvent onto a liquid sample of interest, and desorbing neutral analyte as secondary ions that are then detected via mass spectrometry (MS). Thermal assistance incorporated into the system enhances sensitivity and throughput rate, while allowing direct dynamic detection of the analytes. The intensity of analysis is dependent on positioning of the electrospray emitter, analysis surface and atmospheric inlet of the mass spectrometer.

The present system enhances the sensitivity of detection for compounds that may not be detectable under normal DESI-MS conditions. Most compounds applicable to traditional DESI-MS analysis will yield superior results under the thermally-assisted DESI-MS conditions of embodiments of the invention. Likewise, the present thermally-assisted DESI-MS can be used for direct, continuous analysis of non-aqueous liquid chemicals and/or matrices and lab-generated solutions, making it useful for liquid analyte analysis generally. It can also be used in a discontinuous fashion where analytes are "spot and dried" over intervals before detection is applied. Reactive DESI-MS variations are also applicable to the present thermally-assisted DESI-MS system. Finally, thermal assistance as described herein may also be incorporated into other liquid-based ambient ionization analysis methods.

BRIEF DESCRIPTION OF THE DRAWINGS

In order to aid in understanding embodiments of the invention, exemplary embodiments will now be described with reference to the accompanying drawings in which like numerical designations are given to like features.

DETAILED DESCRIPTION

Figure 1:
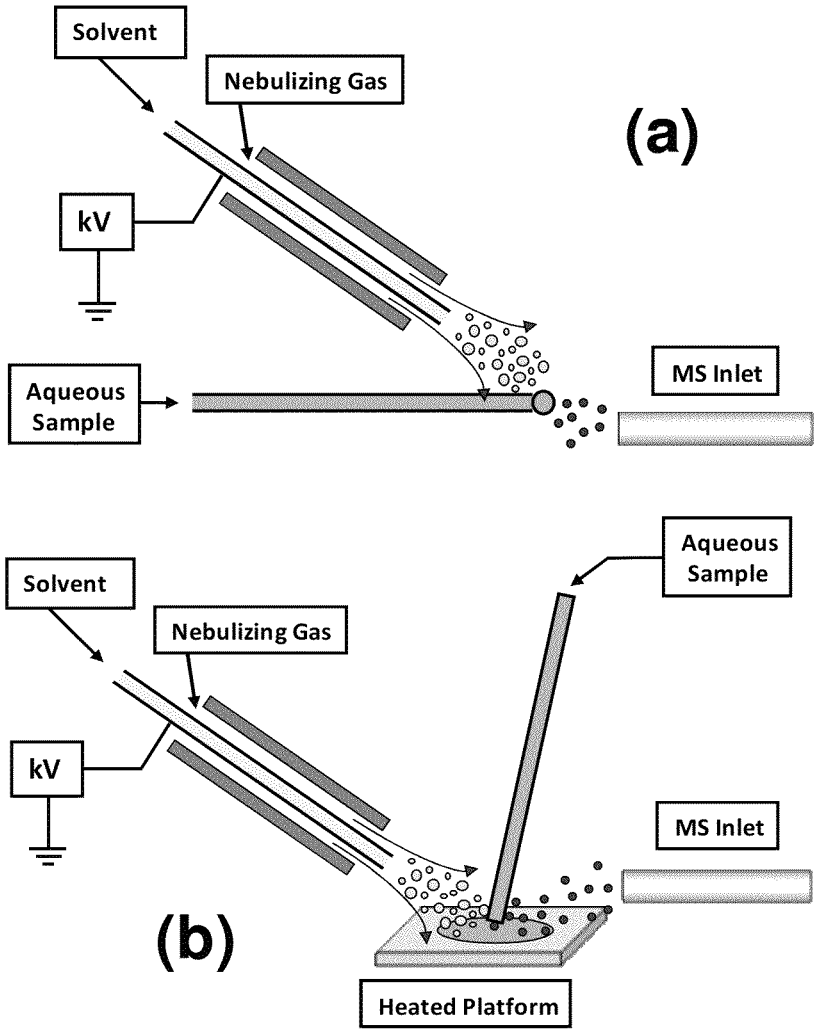
FIG. 1 is a diagrammatic representation of ionization source designs for direct analysis of aqueous samples. Part (a) illustrates direct flow injection DESI-MS (Method 1), where the sample delivery capillary egress serves as the DESI analysis point; and (b) illustrates for thermally-assisted DESI-MS (Method 2), where the aqueous sample is deposited onto a heated platform, which serves as the DESI analysis point.

Embodiments of this invention allow rapid, dynamic analysis of contaminated water samples which need not be specially prepared. For example, the present system can be used in analysis of common PPCP contaminants at low parts per trillion (ppt) levels in tap water matrices. Most surprisingly, the present system is able to realize a sensitivity of analyte detection approaching two orders of magnitude greater than traditional DESI-MS analyses of aqueous samples.

Besides allowing rapid, direct analysis and quantitation of unprepared water (and other solvent-borne) samples, the system also has low sample volume requirements, potentially reducing sample handling and shipping costs. Also, coupled with field-portable mass spectrometric instrumentation, embodiments of the system can be used in long-term monitoring programs and remediation efforts, allowing detection of new contaminants as well as detection of degradation and metabolic products of already established contaminants.

Ionization Source.

The ionization source will be a traditional DESI-MS source design modified to incorporate direct infusion of water samples via a controlled-flow capillary delivery system. With traditional DESI-MS, the analysis point is typically a solid surface or condensed phase (i.e. glass slide, pharmaceutical tablet, fabric, skin), and liquid samples are spotted onto appropriate surfaces, pre-dried, and then analyzed. In embodiments of the present system, liquid samples need not be pre-dried. Rather, they are analyzed by introduction of test samples through capillary delivery onto a target location on a heated platform with the end of the capillary or deposition surface serving as the DESI-MS analysis point at which charged microdroplets are applied by an electrospray emitter and the analyte desorbed followed by MS detection.

Delivery Capillary.

The purpose of the delivery capillary is to infuse a liquid stream containing an analyte of interest onto the target location on the heated platform at a controlled rate. Delivery flowrate is controlled to introduce the maximum amount of aqueous sample without significant pooling of sample on the heated surface. Generally the amount of sample being deposited should be equal to that being lost by way of desorption/ionization produced by the DESI emitter and evaporation at the heated surface. The important capillary delivery parameters are aqueous sample flow rate, position of capillary egress (i.e., deposition point) relative to the DESI emitter, and height of delivery capillary relative to the heated surface.

Heated Platform.

The temperature level of the heated surface determines the (enhanced) flowrate of the sample that can be used, with higher temperatures accommodating higher flowrates, meaning that more analyte will be present for DESI ionization, producing higher sensitivity and lower detection limits. While lower temperatures can be used, they will not generally support high flowrates. Also, when printed Teflon (polytetrafluoroethylene) is used as the analysis point, temperatures should be about 220° C. Preferably, when other materials are used the maximum temperature will be about 260° C. When water-borne analytes are tested, the lower limit will be about 72° C. but when organic liquid-borne analytes are tested, the temperature of the heated platform may be as low as 60° C. Also, although Teflon is a preferred analysis point due to its hydrophobicity, chemical inertness, and resistance to contamination, other surfaces which may support higher temperatures can be used, such as glass, metals, or other polymers.

System Parameters.

In the practice of embodiments of the invention, the following DESI-MS set up may be used:

| Parameter | Preferred | More Preferred |
|---|---|---|
| Electrospray voltage | 2.5 to 6.5 kV | 3.5 to 4.5 kV |
| Electrospray solvent flowrate | 1 to 4 μL/min | 1.5 μL/min |
| Nebulizing gas velocity | 300 to 500 m/s | 350 m/s |
| Sprayer angle | 35° to 50° | 40° |
| Emitter tip-to-analysis point distance | 4 to 6 mm | 5 mm |

In the practice of embodiments of the invention, the following preferred and more preferred parameters for DESI-MS applications may be employed:

| Parameter | Preferred | More Preferred |
|---|---|---|
| Aqueous sample flowrate | about 10- to 95 μL/min | about 90 μL/min |
| Angular position of capillary | about ± 1 mm off-axis | On axis |
| Position of capillary egress tip vis-a-vis target location | about 0 to 1.5 mm | about 1 mm |
| Height of capillary egress tip from heated platform | about 0.1 mm to 1.5 mm above heated platform | about 0.5 mm above |
| Distance of target location relative to inlet to MS | about 1.75 to 2.5 mm | about 2 mm |
| Height of MS inlet relative to heated platform | about 0 to 1 mm above heated platform surface | about 0.5 mm above heated platform surface |
| Temperature of heated surface (for aqueous samples) | about 72° C. to 220° C.[a] | about 220° C. |
| Deposited area of aqueous sample | about 0.002 up to 0.126 $cm^2$ | about 0.0314 $cm^2$ |

[a]Broadest range is about 60-260° C.

It is noted with respect to the height of the capillary tip from the heated surface that height determines the accuracy of deposition. If too high, infusion of the aqueous sample onto a specific location is difficult. Also, if the capillary tip is in direct contact with the heated surface, it can heat up and interfere with controlled flow of aqueous sample. Finally, the DESI emitter typically produces an electrospray that covers a circular spot of about 3 mm in diameter, and analyte in the area can be desorbed/ionized for mass analysis. Therefore, in the practice of embodiments of the invention, the deposited area should be smaller than the DESI emitter area to control carryover between samples.

Discontinuous Sample Preparation.

In alternative embodiments, the thermally-assisted DESI-MS ionization source can be operated in a discontinuous fashion (i.e. specific aliquots of liquid sample are infused and then stopped) by simple control of the syringe pumping apparatus of the device. In this way, analytes in liquid/aqueous matrices can be preconcentrated onto a desired substrate to allow further sensitivity enhancements at the possible cost of total analysis time. This is done by alternative infusion intervals with sufficient drying time in between without concurrent DESI-MS analysis. After each "spot-and-dry" interval, the amount of analyte dried/deposited on the surface increases, so that detection of analytes at concentrations even lower than those produced in continuous operation embodiments can be achieved.

Under this discontinuous sample preparation mode, total analysis time and the limit of detection for target analyte(s) are both dependent on the number of spot-and-dry intervals used. This preconcentration technique can be accomplished with the same apparatus used for the continuous thermally-assisted DESI-MS.

Also, in reactive DESI-MS applications, a derivatization reagent can be delivered to the analyte via the DESI spray solvent, with the heated stage serving to thermally catalyze the reaction. In this way, chemical derivatization can be done in real-time prior to MS analysis, and the reactive DESI-MS analyses can benefit from increased reaction kinetics.

Application to Other Ambient Ionization Analysis Methods.

DESI-MS is classified as an ambient MS method, a class of ionization techniques that allow analysis of ordinary, unprepared samples by accomplishing desorption/ionization of the analyte(s) of interest prior to their entrance to the mass spectrometric vacuum system (i.e. at atmospheric pressure and ambient conditions). Since the introduction of DESI-MS, many other ambient MS methods have been developed and reported, each using a novel method to desorb/ionize chemicals from target samples. The routes of desorption/ionization for these techniques are quite diverse and, in many cases, are quite complicated from an experimental aspect. Sensitivity enhancement via thermal enhancement of ionization however, can be readily implemented with these other ambient MS methods that rely on desorption/ionization of analytes prior to detection.

Although alternate ambient MS methods will achieve sensitivity enhancements for aqueous and liquid sample analysis with thermal assistance to ionization as in the case of DESI-MS, the level of enhancement will vary depending on the specific desorption/ionization mechanism utilized and the sample orientation relative to the ionization source. Ambient MS methods that utilize an energetic force (e.g. charge micro-droplets, focused laser light, energetic particles, and heated gases) to desorb analyte from samples of interest and have been shown applicable to liquid-phase matrices will be the most amenable to such thermal assistance. Table 1 lists established ambient MS methods that will be readily adaptable to include thermal assistance with the purpose of enhancing desorption/ionization and hence sensitivity for aqueous/liquid sample analysis. Specific methods have been grouped in terms of the desorption/ionization mechanism utilized.

TABLE 1

Ambient MS Methods Subject to Enhancement with Thermal Assistance.

| Method | Acronym |
|---|---|
| Droplets | |
| Jet desorption extractive electrospray ionization | JeDI |
| Easy ambient sonic spray ionization | EASI |
| Desorption sonic spray ionization | DeSSI |
| Heat/Charged Particles/Plasmas | |
| Atmospheric pressure thermal desorption ionization | APTDI |
| Thermal desorption-based ambient mass spectrometry | TDAMS |
| Desorption atmospheric pressure chemical ionization | DAPCI |
| Desorption corona beam ionization | DCBI |
| Direct analysis in real time | DART |
| Desorption atmospheric pressure photoionization | DAPPI |
| Plasma-assisted desorption/ionization | PADI |
| Dielectric barrier discharge ionization | DBDI |
| Low temperature plasma probe | LTP |
| Atmospheric pressure glow discharge ionization | APGDI |
| Flowing atmospheric-pressure afterglow | FAPA |
| Desorption electrospray metastable-induced ionization | DEMI |
| Laser Desorption/Ablation | |
| Laser desorption/atmospheric pressure chemical ionization | LD/APCI |
| Electrospray-assisted laser desorption/ionization | ELDI |
| Laser ablation with electrospray ionization | LAESI |
| Infrared laser assisted desorption electrospray ionization | IR LADESI |
| Matrix-assisted laser desorption electrospay ionization | MALDESI |
| Laser electrospray ionization | LEMS |
| Laser desorption spray post-ionization | LDSPI |
| Laser-induced acoustic desorption electrospay ionization | LIAD-ESI |

Mechanism.

While it is not intended to limit the protection of embodiments of the invention by the theory of its operation, it is believed that as the aqueous sample is infused onto the heated platform, it quickly increases in temperature and this leads to evaporation of water in the sample, increasing the concentration of analyte in the progeny droplets leaving the surface as result of the "droplet pickup" desorption mechanism of DESI-MS. The progeny droplets leaving the surface will also have a higher temperature, further assisting solvent evaporation and allowing the Rayleigh limit of the droplets to be attained rapidly, leading to a larger population of gas-phase analyte ions being generated before entrance and during transport through the heated MS inlet. The size of the desorbed droplets has a dramatic effect on the angle of departure from the surface, and smaller droplets have a low altitude trajectory, gliding just above the sample surface. Since incorporating thermal assistance potentially affects the size of generated droplets that leave the heated surface, this would lead to preferential generation of small droplets, and depending on the source alignment in respect to the MS inlet, will also lead to higher efficiency collection of analyte ions and sensitivity.

EXAMPLES

The direct flow injection and thermally assisted methods employed in the following examples were conducted as set forth below:

Method 1. Direct Flow Injection DESI-MS.

For purposes of comparison to the thermally-assisted DESI-MS of embodiments of the invention, a commercially-available DESI source (OmniSpray™ Source, available from Prosolia, Inc. of Indianapolis, Ind.) was used. The Omni Spray™ source consists of x-y-z positioners that allow movement of both the sample platform and electrospray emitter and CCD cameras, allowing flexibility, precision and accuracy in positioning. A tangent arm rotary stage allows precise angular adjustment of the electrospray emitter from 0 to 90°. To allow direct flow injection, referred to as Method 1 (FIG. 1*a*), a fused-silica capillary (I.D. 100 μm, O.D. 150 μm, Agilent Technologies, Santa Clara, Calif.) was used to infuse aqueous samples from a Gastight® syringe available from Hamilton Co. of Reno, Nev. controlled by a syringe pump (Harvard Apparatus, Holliston, Mass.). This sample delivery capillary was mounted to a glass slide, allowing it to be accurately positioned in respect to the electrospray emitter and atmospheric inlet of the MS instrument. Optimal ion intensities were obtained using a delivery capillary to MS inlet distance of 2 mm, with the delivery capillary positioned 0.5 mm above axis with respect to the MS inlet. The DESI spray solvent (1:1 methanol:water with 1% formic acid) flow rate was 1.5 μL/min, and the aqueous sample flow rate was 2.0 μL/min. For experiments reported below utilizing Method 1, the end of the sample delivery capillary served as the DESI-MS analysis point.

Method 2. Thermally-Assisted DESI-MS.

To evaluate the effect of the thermal assistance employed in embodiments of the invention on DESI-MS analysis of aqueous samples, a fused-silica capillary I.D. 100 μm, O.D. 150 μm (Agilent Technologies, Santa Clara, Calif.) was used to infuse aqueous samples from a Gastight® syringe (Hamilton Co., Reno, Nev.) controlled by a syringe pump (Harvard Apparatus, Holliston, Mass.) directly onto a heated surface, with this surface serving as the DESI-MS analysis point (FIG. 1*b*). A glass slide printed with PTFE wells (Prosolia) was used as the surface, which was placed into a custom machined aluminum mount. For heat delivery, a cartridge heater (Omega Engineering, Inc., Stamford, Conn.) was inserted into the aluminum mount and was regulated with a digital temperature controller with thermocouple feedback (Omega). The sampling surface was maintained at about 220° C., using an infrared thermometer (Omega) for temperature measurement. The sample delivery capillary continuously infused aqueous analyte to a single PTFE well positioned 2 mm from the MS inlet. The electrospray emitter was focused onto this PTFE well, using an incident angle of 40° and emitter-to-sample distance of 5 mm, allowing immediate analysis of the infused aqueous sample. The DESI spray solvent (1:1 methanol:water with 1% formic acid) flow rate was 1.5 μL/min, and the aqueous sample flow rate was varied between 1.0 to 90 μL/min.

Sample Preparation.

For the evaluation of Method 1, aqueous solutions containing dissolved pharmaceutical tablets were investigated. Common over-the-counter (OTC) pharmaceutical tablets including Benadryl® (diphenhydramine), Imodium® A-D (loperamide), Claritin® (loratadine), Sudafed® Congestion (pseudoephedrine), and Sudafed® PE Sinus and Allergy (chlorpheniramine and phenylephrine) were purchased from local retail stores. Stock solutions were prepared by crushing tablets using a mortar and pestle, dissolving in methanol, and centrifuging to remove any insoluble binders. Aqueous samples were prepared from the stock solutions via serial dilutions in deionized water without further purification.

For the evaluation of Method 2, standard solutions of prescription antidepressants (amitriptyline, bupropion, citalopram, clomipramine, duloxetine, fluoxetine, nortriptyline, paroxetine, sertraline, venlafaxine), $\beta_1$ receptor antagonists (antenolol), OTC antihistamines (diphenhydramine, chlorpheniramine), OTC analgesics (acetaminophen), anticonvulsants (carbamazepine), antibacterials (moxifloxacin), steroid hormones (estradiol), and caffeine were purchased from Cerilliant Corp. (Round Rock, Tex.), while the antimicrobial agent triclosan and the insect repellant N,N-diethyl-m-toluamide (DEET) were purchased as standard solutions from AccuStandard, Inc. (New Haven, Conn.). Common species found in cosmetic formulations and agricultural chemicals were also purchased as analytical standards. Aqueous samples were prepared from the stock solutions via serial dilutions in either deionized water or tap water (Normal, Ill., conductivity measured to be 550 μS/cm) without further purification.

An array of environmental contaminants were analyzed with results as reported below.

Example 1

Direct Flow Injection DESI-MS of PPCPs

Representative data was obtained with Method 1 from aqueous solutions containing common antihistamines (diphenhydramine, loratadine, chlorpheniramine), decongestants (phenylephrine, pseudoephedrine) and the antidiarrheal loperamide. The high usage and ease of acquisition of these pharmaceuticals places them at an increased risk of contamination, by both natural excretion and improper disposal.

Figure 2:
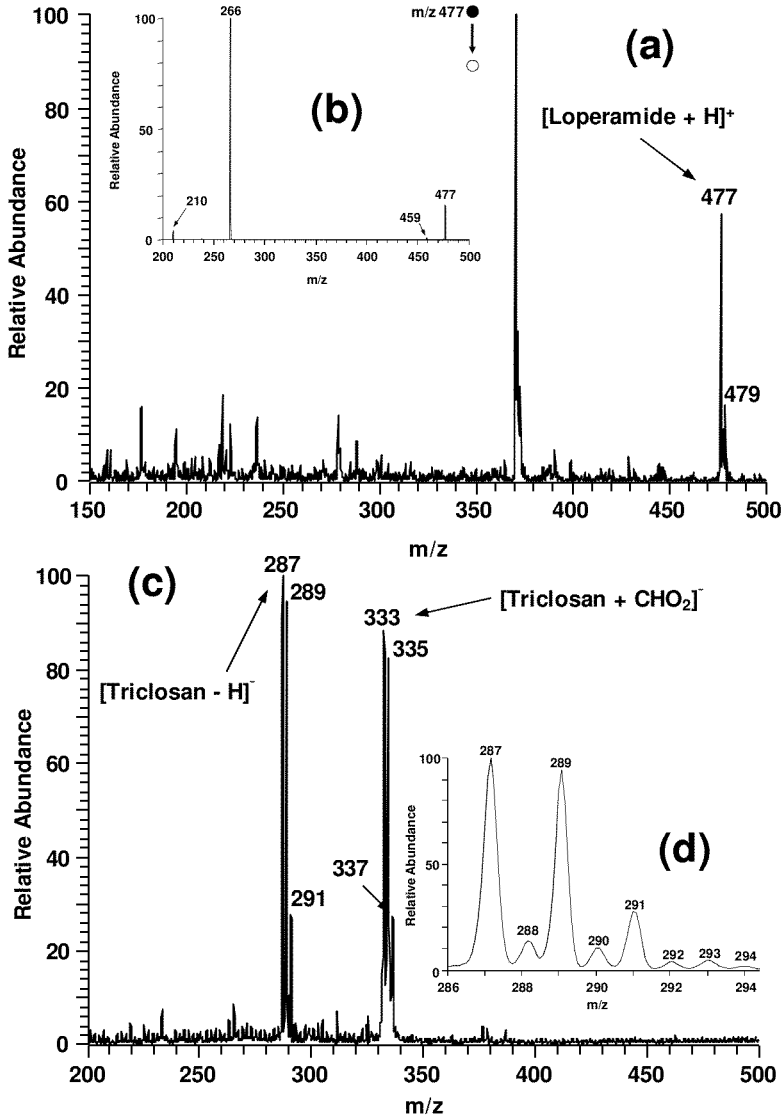
FIG. 2 comprises (a) positive ion DESI mass spectrum using Method 1 for about 2 ppm loperamide in deionized water, where the protonated molecule shows the characteristic chlorine isotopic signature at m/z 477 and 479; (b) $MS^2$ of the m/z 477 precursor ion, yielding characteristic fragment ions at m/z 210, 266, and 459, corresponding to a losses of N,N-dimethyl-2,2-diphenylbutanamide, 4-(p-chlorophenyl)-4-hydroxypiperidine and water, respectively; (c) negative ion DESI mass spectrum using Method 2 for 100 ppb triclosan in deionized water where the deprotonated molecule is a seen as a peak envelope from m/z 287 to 294, with a characteristic trichlorinated isotopic distribution, and a formate adduct, $[M+CHO_2]^-$, can be seen from m/z 333 to 340; and (d) Experimental isotopic abundances coincide well with theoretical yields for the trichlorinated aromatic compound.

FIG. 2*a* shows a positive ion DESI mass spectrum using Method 1 for about 2 parts per million (ppm) loperamide in deionized water. Loperamide, a synthetic derivative of piperadine, acts as an opiod-receptor agonist and is commonly used in antidiarrheal medications.

This aqueous sample was infused at a rate of 2.0 μL/min, with the exit of the sample delivery capillary serving as the DESI analysis point. Mass spectra indicating the presence of loperamide were obtained rapidly, and less than 10 μL of total sample was needed to obtain results. In FIG. 2*a*, the presence of loperamide (MW=477.037 g/mol) was confirmed by the protonated molecule $[M+H]^+$, seen as a doublet at m/z 477 and 479 due to the characteristic chlorine isotopic signature. Further confirmation was obtained by tandem MS ($MS^2$) analysis, as seen in FIG. 2*b*, which yields characteristic fragment ions at m/z 210, 266 and 459, corresponding to a losses of N,N-dimethyl-2,2-diphenylbutanamide, 4-(p-chlorophenyl)-4-hydroxypiperidine and water, respectively, similar to losses reported in ESI-MS literature.

Utilizing direct flow injection DESI-MS, typical limits of detection ranged from 10 to 100 parts per billion (ppb) for the target analytes using single reaction monitoring (SRM) scan modes. Typical concentrations of PPCPs in environmental samples however can range from low ppb in untreated sources like sewage effluent to low or sub-ppt in processed water supplies and aquatic environments which means that conventional direct flow injection DESI-MS cannot generally meet these requirements.

Example 2

Thermally-Assisted DESI-MS of PPCPs

In contrast to the results obtained for Method 1 in Example 1, decreased detection limits for infused aqueous samples were obtained by deposition onto a heated surface, with this surface serving as the DESI-MS analysis point using Method 2. Representative data obtained with Method 2 from an aqueous solution containing triclosan can be found in FIG. 2.

Triclosan was selected as a target analyte due to its common use in antibacterial hygiene products, including soaps, shampoos, deodorants, lotions and toothpaste, and its emergence as a persistent contaminant in natural waters. FIG. 2*c* shows a negative ion DESI mass spectrum using Method 2 for 100 ppb triclosan in tap water. As a trichlorinated aromatic compound, triclosan is seen as a characteristic envelope of peaks from m/z 287 to 294, corresponding to the deprotonated molecule, and experimental isotopic abundances coincided well with theoretical yields (FIG. 2*d*). The mass spectrum also shows a similar isotopic distribution from m/z 333 to 340, corresponding to formate adduct formation, $[M+CHO_2]^-$, which has been seen in atmospheric pressure chemical ionization (APCI-MS) analyses of aromatic explosives under similar solvent conditions.

The DESI spray solvent utilized for the entire series of analyses was 1:1 methanol:water with 1% formic acid, and while adjusting the solvent system can provide better sensitivity on a per compound basis, a single system was used to simplify the overall method. The presence of formate in the spray solvent leads to this characteristic adduct, adding additional selectivity to the analysis of triclosan. Adding reactive species to the spray solvent has been termed reactive DESI-MS, and maintaining this ability with Method 2 allows flexibility in analyzing contaminants of interest.

Chlorpheniramine, a histamine receptor antagonist, is commonly incorporated individually or in conjunction with decongestants in pharmaceutical compositions. Positive ion DESI analysis utilizing Method 2 yielded the protonated molecule for chlorpheniramine with a chlorine isotopic distribution at m/z 275 and 277. The $MS^2$ spectrum of the m/z 275 precursor ion (corresponding to the $^{35}Cl$ isotope), which dissociates by loss of ethylamine to produce an ion of m/z 230.

A positive ion DESI mass spectrum was obtained using Method 2 for 100 ppb citalopram in tap water. Citalopram is in the selective serotonin reuptake inhibitor (SSRI) class of antidepressants, and is marketed as the product Celexa®. Citalopram is seen as the protonated molecule at m/z 325. Fragmentation of the m/z 325 precursor yields several product ions with the main product at m/z 262 corresponding to a loss of 2-fluoro-ethylamine.

Example 3

Complex Mixture Analysis

Since real environmental samples can vary in terms of chemical complexity, the robustness of Method 2 to multi-component sample analysis was examined in this example.

Figure 3:
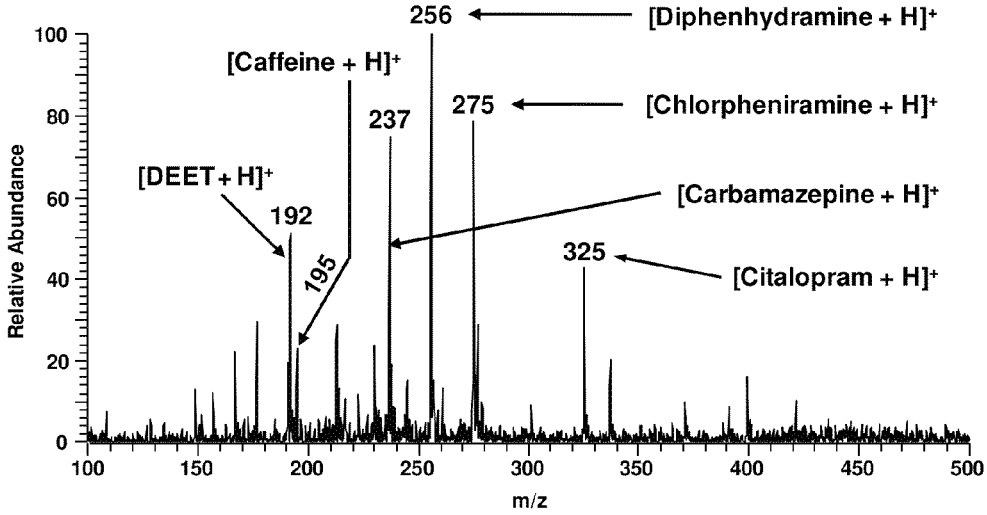
FIG. 3 is a positive ion DESI mass spectrum of tap water spiked with 1 ppb each of DEET (m/z 192), caffeine (m/z 195), carbamazepine (m/z 237), diphenhydramine (m/z 256), chlorpheniramine (m/z 275 and 277), and citalopram (m/z 325).

FIG. 3 thus shows a positive ion DESI mass spectrum of tap water spiked with 1 ppb each of DEET (m/z 192), caffeine (m/z 195), carbamazepine (m/z 237), diphenhydramine (m/z 256), chlorpheniramine (m/z 275 and 277), and citalopram (m/z 325), all confirmed by tandem MS analysis. Even at a relatively low concentration, analytes of interest can still be discerned from the noise level in the full scan mass spectrum, showing the sensitivity of the thermally-assisted DESI-MS of embodiments of the system for aqueous PPCP analysis The variance among peak intensities is indicative of differing ionization efficiencies, but also could be the result of charge competition amongst the analytes.

Example 4

Sensitivity Enhancements and Detection Limits from Thermal Assistance

To assess how the thermal assistance afforded by Method 2 affected sensitivity of analysis, ion intensities were examined for both chlorpheniramine and citalopram with and without heat applied to the deposition surface. For comparison purposes, integrated peak areas for the major transition were obtained via SRM scan mode for both analytes at a concentration of 1 ppb, and the average of three separate experimental runs was calculated. Applying thermal assistance to the deposition surface resulted in signal enhancements of 1.54 and 1.60 orders of magnitude for chlorpheniramine and citalopram, respectively, correlating to about 1.5 orders of magnitude lower detection limits for these compounds by heating the surface serving as the DESI analysis point to 220° C.

Figure 4:
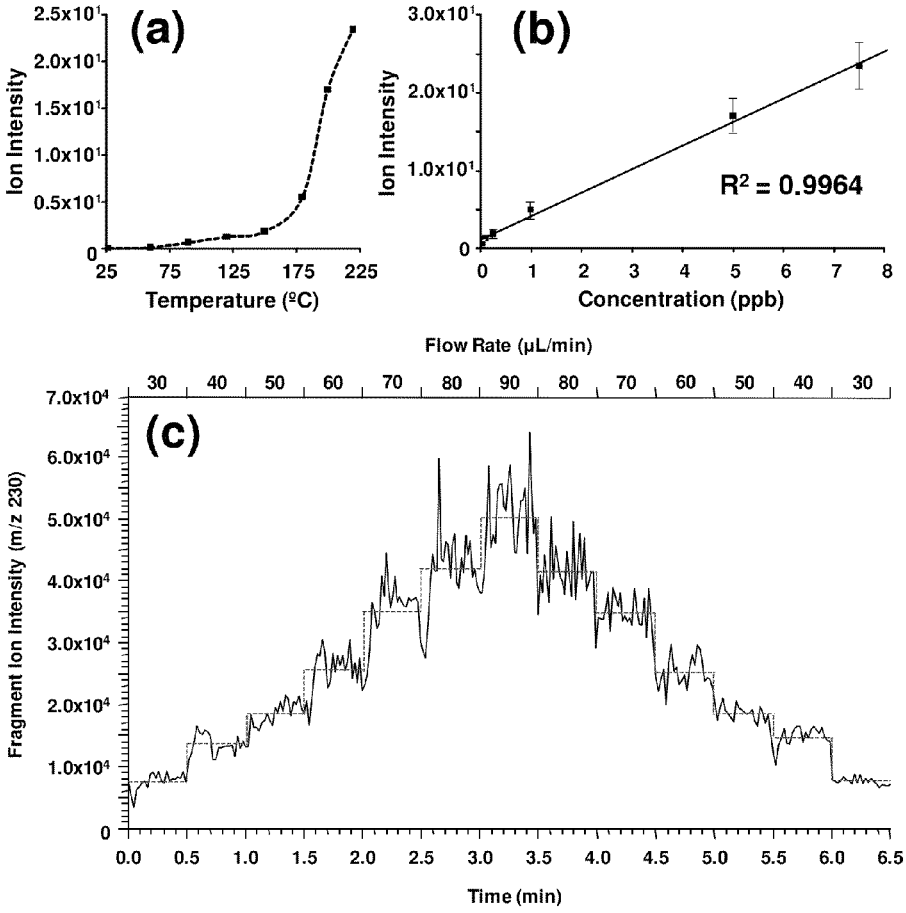
FIG. 4 comprises a characterization of thermally-assisted DESI-MS for aqueous PPCP analysis: (a) Effect of deposition surface temperature on the signal intensity of the SRM transition of chlorpheniramine; (b) Calibration curve generated from aqueous solutions of citalopram, ranging from the limit of quantitation of 20 ppt to 7500 ppt. where the correlation coefficient resulting from these analyses was 0.9964, and relative standard deviations for all calibration points ranged from 6 to 13%, showing decent precision and linearity for the entire quantitation experiment; and (c) Ion chromatogram for the major transition of chlorpheniramine measured as a function of flow rate of infused sample where intensities for specific flow rates during the increasing (0.0 to 3.0 min) and decreasing (3.5 min to 6.5 min) time intervals are congruent, showing a resistance to carryover effects at moderate concentrations.

A systematic study of the sensitivity enhancement from thermal assistance can be seen in FIG. 4*a*, where the signal intensity of the major SRM transition of chlorpheniramine (m/z 230, loss of ethylamine) was monitored as a function of deposition surface temperature. The temperature range investigated extended from room temperature (25° C.) to a maximum of 220° C. As seen, an increase in signal intensity was immediately gained upon raising the deposition surface temperature, with the most pronounced increase beginning around 175° C. This steep increase extends to the maximum temperature investigated. Higher temperatures were investigated, but 220° C. was determined to be optimal for thermal assistance, as significant boiling of the infused aqueous sample was seen after this temperature and the PTFE used as the deposition/analysis surface undergoes thermal degradation at 260° C.

Table 2 provides a summary of limit of detection (LOD) studies for select PPCP in tap water matrices performed with Method 2, including major SRM transitions and associated fragmentation.

TABLE 2

Major SRM Transitions and Detection Limits for Select PPCPs Spiked in Tap in Tap Water.

| Compound | Precursor ion (m/z) | SRM Transition (m/z) | LOD (ppt) |
|---|---|---|---|
| Antidepressants | | | |
| bupropion | 240 $[M + H]^+$ | 184 $[M - C_4H_8 + H]^+$ | 10 |
| citalopram | 325 $[M + H]^+$ | 262 $[M - C_2H_6NF + H]^+$ | 9.0 |
| venlafaxine | 278 $[M - H]^+$ | 260 $[M - H_2O + H]^+$ | 25 |
| Antihistamines | | | |
| chlorpheniramine | 275 $[M + H]^+$ | 230 $[M - C_2H_7N + H]^+$ | 18 |
| diphenhydramine | 256 $[M + H]^+$ | 167 $[M - C_4H_{11}NO + H]^+$ | 76 |
| Analgesics | | | |
| acetaminophen | 152 $[M + H]^+$ | 110 $[M - CH_2 - CO + H]^+$ | 23 |
| Anticonvulsant | | | |
| carbamazepine | 237 $[M + H]^+$ | 194 $[M - CHNO + H]^+$ | 0.90 |

TABLE 2-continued

Major SRM Transitions and Detection Limits for Select PPCPs Spiked in Tap in Tap Water.

| Compound | Precursor ion (m/z) | SRM Transition (m/z) | LOD (ppt) |
|---|---|---|---|
| Personal Care Products | | | |
| DEET | 192 $[M + H]^+$ | 119 $[M - C_4H_{11}N + H]^+$ | 8.0 |
| caffeine | 195 $[M + H]^+$ | 138 $[M - C_2H_3NO + H]^+$ | 43 |
| triclosan | 287 $[M - H]^-$ | N/A* | |
| | 333 $[M + CHO_2]^-$ | | |

*Not applicable. Major product ion ($^{35}Cl^-$) below low mass cutoff of Thermo LCQ Fleet DESI-MS analyses of infused aqueous PPCP contaminants routinely gave very desirable low ppt detection limits when incorporating thermal assistance. All reported detection limits were experimentally obtained, utilizing the traditional LOD threshold of 3 for the signal-to-noise ratio.

Detection limit studies for triclosan were accomplished in full scan mode, as the major product ion for this contaminant is $^{35}Cl^-$, which lies below the low mass cutoff of the mass spectrometer utilized. In full scan mode, the LOD of triclosan was 30 ppb, a bit higher than full scan mode LODs obtained for other PPCPs analyzed (typically 1-10 ppb), but a significant amount of ion intensity is distributed among the isotopic ions, as well as those for the formate adduct (FIG. 2*c*).

Sub-ppt detection limits were obtained for the anticonvulsant carbamazepine, which yielded a LOD of 900 parts per quadrillion (ppq). While this result represents the lowest LOD obtained for the selected PPCPs, breaking the ppq threshold is a notable achievement, as this is similar performance of hyphenated mass spectrometric methods that utilized extensive sample preparation and preconcentration.

Summary of Examples 1-4

Substantial and unexpected sensitivity enhancement was realized from thermally-assisted DESI-MS embodiments of the present system. If the above methodology is applied to other environmental water samples, such as sewage effluent, ground, and surface water samples, (though these matrices will have varying chemical complexity, salt concentration, pH and particulate matter), similar results to those obtained in Examples 1-4 will follow. Thus, the methodology is also applicable to broad range of possible aqueous contaminants including, for example, agricultural chemicals, illicit drugs, byproducts of industrial processes, and compounds of relevance to environmental forensics and homeland security, and others.

Example 5

Quantitation and Optimization of Sample Flow Rate

While rapid monitoring of aqueous PPCP contaminants is of high interest for environmental protection purposes, the ability to quantify these species is important to help assess remediation efforts and establish geographical and temporal trends of contaminant plumes.

FIG. 4*b* shows a calibration curve generated from tap water solutions of citalopram ranging from the limit of quantitation (LOQ) of 20 ppt to 7500 ppt. For comparison purposes, integrated peak areas for the major transition (m/z 262, loss of 2-fluoro-ethylamine) were obtained via SRM scan mode, and the average of three separate experimental runs was calculated. The correlation coefficient ($R^2$) resulting from these analyses was 0.9964, and relative standard deviations for all calibration points ranged from 6% to 13%, showing satisfactory precision and linearity for the entire quantitation experiment. Of note, the precision and linearity using Method 2 is comparable to quantitative DESI-MS analyses reported that utilize internal standards and automated positioning systems. The linear dynamic range (LDR) for quantitation of citalopram was approaching three orders of magnitude without utilizing software-controlled automatic gain control (AGC). Implementing AGC into quantitative experiments will yield larger ranges of linearity for concentrated sample analysis.

Example 6

Flow Rates

For thermally-assisted DESI-MS of infused aqueous samples, sample flow rates have a dramatic effect on analyte ion intensity. Optimization of sample flow rates was accomplished by monitoring the peak height for the major transition via SRM scan mode of a 100 ppb aqueous solution of chlorpheniramine over a range of 1.0 to 120 μL/min. Ion intensity increased linearly with flow rate over this range, and 90 μL/min was determined to optimal, as it provided the highest intensity while being resistant to pooling of aqueous sample on the deposition surface. Flow rates higher than 90 μL/min overcame solvent evaporation from thermal assistance and sample removal via the desorption mechanism of DESI-MS, causing pooling of sample by the MS atmospheric inlet. Pooling of sample on the deposition surface could lead to carryover effects, but more importantly, allowing condensed phases like water to enter the atmospheric inlet could be detrimental to the MS vacuum system. When utilizing a sample flow rate of 90 μL/min and a deposition surface temperature of 220° C., mass spectral data can be collected in about one minute, leading to a total sample consumption of less than 100 μL.

FIG. 4*c* shows an ion chromatogram for the major transition of chlorpheniramine (m/z 230) measured as a function of flow rate of infused sample. Flow rates were incrementally increased by 10 μL/min at 0.5 min intervals from 30 to 90 μL/min and then decreased using similar syringe pump settings back to 30 μL/min. For this analysis, the DESI-MS analysis point and concentration of aqueous analyte were held constant. At the beginning of each time interval, the chromatogram slightly declines, an artifact due to the syringe pump adjusting to the new flow rate that could be reduced by using a pulse dampener. For each time interval, RSDs were calculated for the respective data, including the artifact due to syringe pumping. Interval RSDs ranged from 5.0 to 18%, and the average RSD over all intervals was 8.3%. The average intensity of m/z 230 was calculated for the respective data of each interval and plotted as the step-wise, dotted line overlay (shown in red). Of note, intensities for specific flow rates during the increasing (0.0 to 3.0 min) and decreasing (3.5 min to 6.5 min) time intervals are congruent, demonstrating the reproducibility of the technique, but more importantly, showing a resistance to carryover effects at moderate concentrations.

Example 7

Breadth of Application of Thermally-Assisted DESI-MS

Representative data for commonly-found environmental water samples were collected with thermally-assisted DESI-MS to demonstrate its potential for broad application to general water quality monitoring. This includes, but is not limited to, common OTC drugs, prescription pharmaceuticals, abused and illicit pharmaceuticals, compounds related to personal care products, and agricultural chemicals. As the nature of authentic contaminated water samples is quite complex, it is important that corresponding analysis methods are not only capable of detecting known contaminants, but are also likely to be applicable to future contaminants. The current DESI-MS literature is extensive in terms of applicable chemical classes, with new advances continually being developed. Of note, analysis of difficult species in terms of detection ability and sensitivity can be enhanced by adding chemical reagents to the DESI spray solvent, a process known as reactive DESI-MS; reactive DESI-MS is used to detect the formate adduct of the water contaminant triclosan in tap water with thermally-assisted DESI-MS, as seen in FIG. 2*c*).

The use of the terms "a" and "an" and "the" and similar referents in the context of describing embodiments of the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. It should be understood that the illustrated embodiments are exemplary only, and should not be taken as limiting the scope of the invention.

What I claim is:

1. A high sensitivity desorption electrospray ionization mass spectrometry system comprising:

a heated platform with a target location for receiving a liquid stream containing an analyte of interest where the liquid stream is directed onto the target location from a location spaced from the target location;

means for directing the liquid stream containing an analyte of interest onto the target location on the heated platform to heat the stream;

an electrospray emitter for generating an electrospray and directing the electrospray at the target location on the heated platform to produce an ionized, desorbed analyte; and a mass spectrometer for receiving and detecting the ionized, desorbed analyte.

2. The high sensitivity desorption electrospray ionization mass spectrometry system of claim 1 in which the heated platform is maintained at a temperature in the range of about 60° C. to about 260° C.

3. The high sensitivity desorption electrospray ionization mass spectrometry system of claim 1 in which the heated platform is maintained at a temperature in the range of about 72° C. to about 220° C.

4. The high sensitivity desorption electrospray ionization mass spectrometry system of claim 1 in which the heated platform is maintained at a temperature of about 220° C.

5. The high sensitivity desorption electrospray ionization mass spectrometry system of claim 1 in which the platform is coated with polytetrafluoroethylene.

6. The high sensitivity desorption electrospray ionization mass spectrometry system of claim 1 in which the liquid stream contains water.

7. The high sensitivity desorption electrospray ionization mass spectrometry system of claim 1 in which the liquid stream contains a liquid other than water.

8. The high sensitivity desorption electrospray ionization mass spectrometry system of claim 1 in which the liquid stream is an aqueous stream containing the analyte of interest and the flow rate of the stream is about 10 to 95 μL/min.

9. The high sensitivity desorption electrospray ionization mass spectrometry system of claim 1 in which the liquid stream is an aqueous stream containing the analyte of interest and the flow rate of the stream is about 90 μL/min.

10. The high sensitivity desorption electrospray ionization mass spectrometry system of claim 1 in which the means for directing the liquid stream comprises a capillary with an egress tip and the egress tip is about 0 to 1.5 mm from the target location on the heated platform.

11. The high sensitivity desorption electrospray ionization mass spectrometry system of claim 1 in which the means for directing the liquid stream comprises a capillary with an egress tip and the egress tip is about 1 mm from the target location on the heated platform.

12. The high sensitivity desorption electrospray ionization mass spectrometry system of claim 1 in which the means for directing the liquid stream comprises a capillary with an egress tip and the egress tip is about 0.1 mm above the surface of the heated platform.

13. The high sensitivity desorption electrospray ionization mass spectrometry system of claim 1 in which the means for directing the liquid stream comprises a capillary with an egress tip and the egress tip is about 0.5 mm above the surface of the heated platform.

14. The high sensitivity desorption electrospray ionization mass spectrometry system of claim 1 in which the mass spectrometer includes an inlet and the distance of the target location relative to the inlet is about 1.75 to 2.5 mm.

15. The high sensitivity desorption electrospray ionization mass spectrometry system of claim 1 in which the mass spectrometer includes an inlet and the distance of the target location relative to the inlet is about 2 mm.

16. The high sensitivity desorption electrospray ionization mass spectrometry system of claim 1 in which the mass spectrometer includes an inlet and the height of the MS inlet relative to the heated platform is about 0 to 1 mm.

17. The high sensitivity desorption electrospray ionization mass spectrometry system of claim 1 in which the mass spectrometer includes an inlet and the height of the MS inlet relative to the heated platform is about 0.5 mm.

18. The high sensitivity desorption electrospray ionization mass spectrometry system of claim 1 in which the liquid stream is delivered to the heated platform by a delivery capillary at a rate equal to or less than the rate at which the stream is being dissipated by desorption and evaporation.

19. The high sensitivity desorption electrospray ionization mass spectrometry system of claim 1 in which the liquid stream is a solvent-borne analyte stream and a plurality of aliquots of the stream are each infused onto the heated platform and then dried after which the electrospray is directed onto the target location containing the analyte remaining from the plurality of separately dried aliquots and the ionized, desorbed analyte is received and detected by the mass spectrometer.

20. The high sensitivity desorption electrospray ionization mass spectrometry system of claim 19 in which the heated platform is maintained at a temperature at least equal to the boiling point of the solvent of the solvent-borne analyte stream.

21. The high sensitivity desorption electrospray ionization mass spectrometry system of claim 1 in which a derivatization reagent is added to the electrospray whereby the heated platform thermally catalyzes the reaction between the analyte and the reagent.

22. A high sensitivity desorption electrospray ionization mass spectrometry system comprising:

a heated platform for receiving a liquid stream maintained at a temperature in the range of about 72° C. to about 220° C.;

means for directing an aqueous stream containing an analyte of interest at a flow rate of about 10 to 95 μL/min onto a target location on the heated platform to heat the stream, where the liquid stream is directed onto the target location from a location spaced from the target location;

an electrospray emitter for generating an electrospray and directing the electrospray at the target location on the heated platform to produce an ionized, desorbed analyte; and a mass spectrometer for receiving and detecting the ionized, desorbed analyte.

23. The high sensitivity desorption electrospray ionization mass spectrometry system of claim 22 in which the platform is coated with polytetrafluoroethylene.

24. The high sensitivity desorption electrospray ionization mass spectrometry system of claim 22 in which the means for directing the liquid stream comprises a capillary with an egress tip and the egress tip is about 0 to 1.5 mm from the target location on the heated platform and about 0.1 mm above the surface of the heated platform.

25. The high sensitivity desorption electrospray ionization mass spectrometry system of claim 22 in which the mass spectrometer includes an inlet, the distance of the target location relative to the inlet is about 1.75 to 2.5 mm and the height of the MS inlet relative to the heated platform is about 0 to 1 mm.

26. The high sensitivity desorption electrospray ionization mass spectrometry system of claim 22 in which the aqueous stream is delivered to the heated platform by a delivery capillary at a rate equal to or less than the rate at which the stream is being dissipated by desorption and evaporation.

27. A method of detecting analytes in an aqueous stream comprising:

providing a heated platform with a target location for receiving a liquid stream;

directing a liquid stream containing an analyte of interest onto the target location on the heated platform to heat the stream, where the liquid stream is directed onto the target location from a location spaced from the target location;

providing an electrospray emitter for generating an electrospray and directing the electrospray at the target location on the heated platform to produce an ionized, desorbed analyte; and providing a mass spectrometer for receiving the ionized, desorbed analyte and detecting the ionized, desorbed analyte.

* * * * *